US005104255A

United States Patent [19]

Bodensohn

[11] Patent Number: 5,104,255

[45] Date of Patent: Apr. 14, 1992

[54] BARRIERS FOR LANE DIVIDERS, CURBS OR CONSTRUCTION SITES

[76] Inventor: Karl H. Bodensohn, Ulmenstr. 40, 6052 Mühlheim, Fed. Rep. of Germany

[21] Appl. No.: 549,380

[22] Filed: Jul. 6, 1990

[51] Int. Cl.[5] ..... E01C 11/22; E01F 15/00

[52] U.S. Cl. ..... 404/7; 404/6; 256/13.1

[58] Field of Search ..... 404/6–9; 256/1, 13.1

[56] References Cited

U.S. PATENT DOCUMENTS

| | | | |
|---|---|---|---|
| 696,792 | 4/1902 | Bedell | 404/7 |
| 722,580 | 3/1903 | Hill | 404/7 |
| 1,683,121 | 9/1928 | Baldwin | 404/6 |
| 3,174,412 | 3/1965 | Boyd et al. | 404/7 X |
| 3,326,099 | 6/1967 | Cova et al. | 404/7 |
| 3,373,668 | 3/1968 | Moore et al. | 404/7 X |
| 3,980,279 | 9/1976 | Bofinger | 256/13.1 |
| 4,040,759 | 8/1977 | Skalle | 404/6 |
| 4,059,362 | 11/1977 | Smith | 404/6 |
| 4,105,353 | 8/1978 | Bork et al. | 404/6 |
| 4,111,401 | 9/1978 | Pickett | 256/13.1 |
| 4,869,617 | 9/1989 | Chiodo | 404/6 |
| 4,946,306 | 8/1990 | Yodock | 404/6 |

FOREIGN PATENT DOCUMENTS

| | | |
|---|---|---|
| 268361 | 2/1965 | Austria . |
| 357195 | 12/1978 | Austria . |
| 65199 | 5/1982 | European Pat. Off. . |
| 2585047 | 7/1985 | France . |

*Primary Examiner*—Ramon S. Britts
*Assistant Examiner*—Nancy P. Connolly
*Attorney, Agent, or Firm*—Collard, Roe & Galgano

[57] ABSTRACT

A barrier is comprised of a plurality of hollow shaped bodies of plastic material and each shaped body comprises a wide base portion having a bearing face supporting the shaped body on a surface and a narrower upper portion, the wide base and narrower upper portions having two side walls, the portions of the side walls of the upper portion merging into the portions of the side walls of the base portion. Respective partially cylindrical end faces extend between the side walls, the end face at one end of the shaped body being convex and the end face at an opposite end being correspondingly concave whereby adjacent end faces of successive ones of the shaped bodies in the barrier mate with each other. The side walls have transitory portions converging towards the end faces, a horizontally extending locking groove extends across the concave end face, the groove being open at the side walls and on top, and a mating locking ledge extends horizontally across the convex end face at the same level as the locking groove whereby the locking edge may be inserted in an adjacent locking groove of the succesive shaped bodies for connecting the shaped bodies.

7 Claims, 3 Drawing Sheets

Fig.1
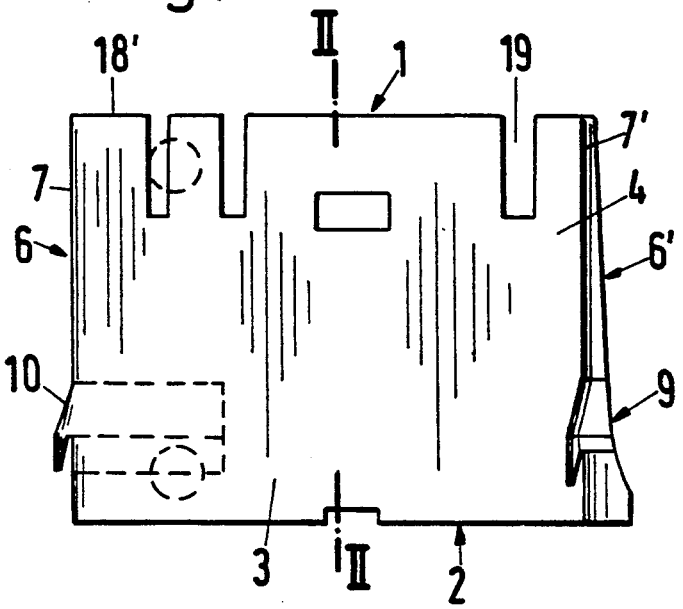
Fig.2
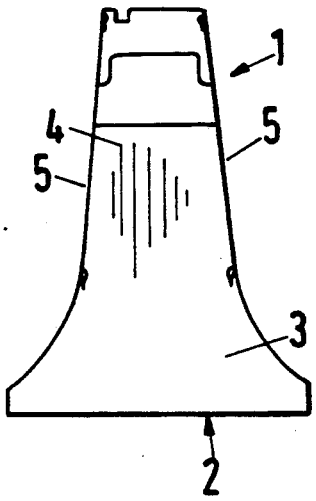
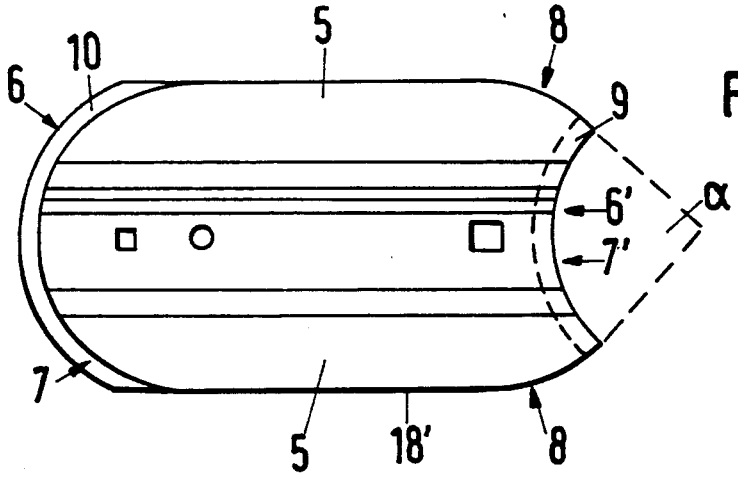
Fig.3
Fig.4
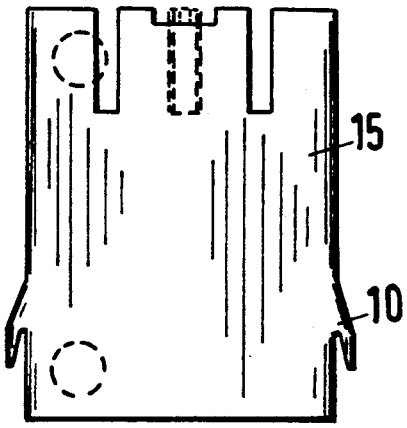

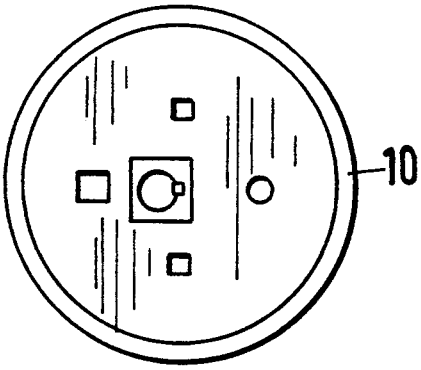
Fig.5
Fig.6
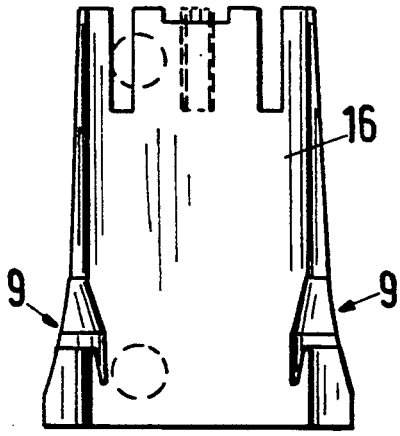
Fig.7
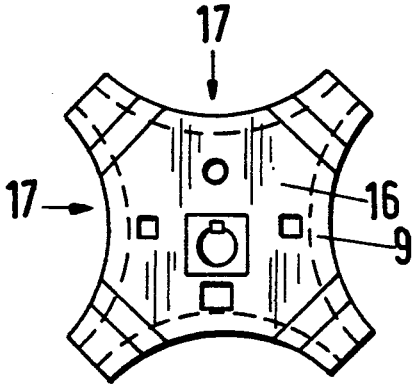
Fig.9
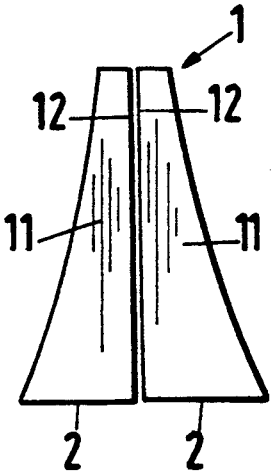
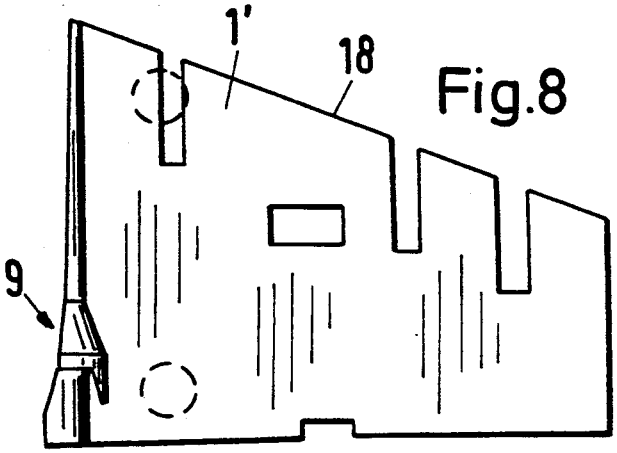
Fig.8

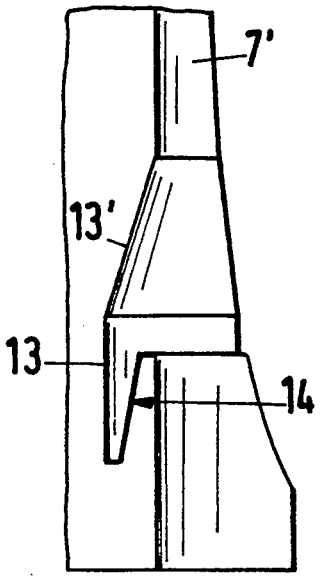
Fig.12
Fig.10
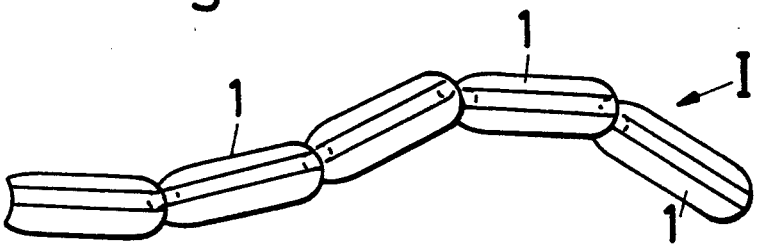
Fig.11
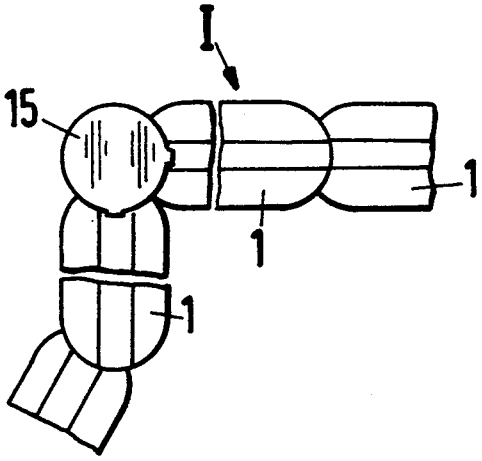

BARRIERS FOR LANE DIVIDERS, CURBS OR CONSTRUCTION SITES

The present invention is concerned with a barrier, in particular, for separating lanes, side-walks or construction sites.

BACKGROUND OF THE INVENTION

French patent No. 2,585,047 discloses a barrier comprised of a plurality of hollow shaped bodies of plastic material, each shaped body comprising a wide base portion having a bearing face supporting the shaped body on a surface, a narrower upper portion, the wide base and narrower upper portions having two side walls, the portions of the side walls of the upper portion merging into the portions of the side walls of the base portion, and respective end faces extending between the side walls, which have hinge-type elements which may be bolted together for interconnecting the shaped bodies. A hinge-type interconnection of the elements is also possible with the elements according to AT 357195 or AT 268361. The elements according to these two documents, also in the area of their connecting faces, are formed to overlap, while those according to FR 2585047 are provided with hinge-type flaps protruding from the front faces, with the elements in either of these cases being able to be interconnected by bolting. The elements according to the two Austrian patents incidentally, are heavy concrete units permitting a certain amount of movability with respect to one another in view of a correspondingly arcuate configuration of the end faces optionally provided with key-and-slot type end faces (AT 268361). However, vertically oriented key-and-slot-type boltings destroy the connection and the shaped bodies, respectively, when exposed to lateral load, as do bores.

OBJECTS OF THE INVENTION

Starting from the subject matter of FR-2585047, the problem to be solved by the invention resides in providing a barrier, the individual units of which can be manufactured at low cost, are of a low weight and can snugly be lined up with other units of corresponding shape not only along a rectilinear but also along a curved path with no gaps in-between, at the same time permitting, through simple shaping, one the one hand, safe locking without bolting and, on the other hand, permitting a relatively easy separation under lateral exposure of the units to load.

SUMMARY OF THE INVENTION

In accordance with the invention, the barrier for the separation of lanes, side-walks or construction sites, is composed of a plurality of hollow shaped bodies of plastic material, each shaped body comprising a wide base portion having a bearing face supporting the shaped body on a surface and a narrower upper portion. The wide base and narrower upper portions have two side walls, the portions of the side walls of the upper portion merging into the portions of the side walls of the base portion. Respective partially cylindrical end faces extend between the side walls, the end face at one end of the shaped body being convex and the end face at an opposite end being correspondingly concave whereby adjacent end faces of successive ones of the shaped bodies in the barrier fit into each other, and the side walls having transitory portions converging towards the end faces. A horizontally extending locking groove extends across the concave end face, the groove being open at the side walls and on top, and a matching locking ledge extends horizontally across the convex end face at the same level as the locking groove whereby the locking edge may be inserted in an adjacent locking groove of the successive shaped bodies for connecting the shaped bodies.

ADVANTAGES OF THE INVENTION

The combined features and design of the barrier according to the invention provide a barrier the individual elements of which are of a low weight, are suitable for individual mounting but can be easily put together with other elements of corresponding design not only along a rectilinear but also along a curvilinear path to form a substantially gapless, wall-type barrier. As the shaped bodies are of hollow configuration they are easily transported and mounted, as stated before, it being advantageous that the element(s), after installation, can be filled, at least in part, with water or, optionally with sand. To comply with the requirement of a gapless lining capability of the elements along a curvilinear path together with other similar elements, the side walls converge into the end faces in a transitory area thereby enabling two adjacent units, thanks to the formation of the locking groove and the locking ledge, to be locked together along adjacent end faces.

The arc length of the concave end face advantageously, is defined by an arc angle of 90° , it being essential that the parallel side walls of the element converge toward the end faces either by a correspondingly planar inclination of the end faces or by having the side walls flow into the partially cylindrical end face along a curved line.

The shaped body is of an inverse T-shaped cross-section. The side walls may have a concave curvature, between the wider bottom portion and the narrower upper portion. However, this type of cross-sectional symmetry is not imperative, i.e. one of the side walls also can extend in a direction vertical from top to bottom thus extending from the bearing face in the vertical direction. So configured elements can then be placed, for example, in pairs with their vertical side walls in back-to-back relationship; also it will be possible to mount such elements in cases where no socket portion is to protrude on the side concerned into the separated area. Apart from the fact that it is possible to provide only half the fillet and to correspondingly halve the end face on the other side, in such elements, the fillet and the end faces can be formed on the other side as previously stated. Incidentally, the planar side walls of such elements can be more or less spaced from one another to provide a filling chamber for an earth or sandstone fill.

BRIEF DESCRIPTION OF THE DRAWINGS

Having thus generally described the invention reference will now be made to the accompanying drawings, illustrating preferred embodiments, and in which:

FIG. 1 is a schematical side view of a shaped body of a barrier according to the invention;

FIG. 2 is a schematical cross-sectional view of the shaped body along line II—II of FIG. 1;

FIG. 3 is a plan view of the shaped body according to the invention;

FIG. 4 is a side view of a cylindrical shaped element for provision between two shaped bodies according to FIG. 1;

FIG. 5 is a plan view of the shaped element according to FIG. 4;

FIG. 6 is a side view of a maltese cross-shaped element for provision between two shaped bodies according to FIG. 1;

FIG. 7 is a plan view of the shaped element according to FIG. 6;

FIG. 8 is a side view of a special embodiment of the shaped body;

FIG. 9 shows another special embodiment of the shaped bodies;

FIGS. 10 and 11 show plan views of two barrier patterns, by way of example, and

FIG. 12 is an enlarged sectional view of the locking groove.

DESCRIPTION OF PREFERRED EMBODIMENTS

As shown in FIGS. 1 to 3, the shaped body 1 a hollow body having a narrow upper portion 4 whose side walls 5 merge into the wider lower portion 3 which rises from bearing face 2. The one end side 6 is in the form of a partially cylindrical convex face 7, while the other end side 6' is in the form of a corresponding partial-cylindrical end face 7', with the side walls 5, in the transitory area 8, converging into the end face 7'. In the illustrated embodiment, arcuate areas 8 are identical as shown in FIG. 3. The arc length of the end face is determined by angle $\alpha$, which is 90°, as shown in FIG. 3. This will permit a gapless association of the shaped bodies 1 both along rectilinear and curvilinear paths, as shown in FIG. 10.

In order to enable the shaped bodies 1 of similar configuration not only to be lined up but also to be locked together in simple manner, the shaped bodies 1 having, on the partial-cylindrical convex end face 7 thereof, a locking ledge 10 and on the other end face 7' exhibits a locking groove 9 of corresponding cross-section as shown, in enlarged scale, on an FIG. 12. In illustrated embodiment, the locking groove 9 as shown in cross-section, has a vertical cylindrical flank 13 followed by an upwardly extending conically shaped flank portion 13', along with a conical flank 14 disposed opposite flank 13, which flank 14 ends, as does the conical flank portion 13', within or in the area of the concave end face 7', and tongue-shaped locking ledge 10 protrudes downwardly and is of a corresponding cross-sectional configuration (see FIG. 1). On the one hand, assembly of the shaped bodies 1 is thereby particularly easy and, on the other hand, the shaped bodies are interconnected adequately firmly without forming thereby an absolutely rigidly connected barrier which, in rear-end collision, would be torn apart and destroyed.

As shown by FIG. 9, one of the side walls 5 also may be of a planar configuration and may be disposed in vertical relationship to the bearing face 2, thereby enabling two such halves 11, to be arranged with their planar side walls 12 in back-to-back relationship. Concerning the design of the two end faces 7, 7' of so configured shaped bodies, two alternatives are possible to wit: each of these halves 11, on the one hand, forms half a shaped body corresponding the element according to FIG. 1. Conversely, it would also be possible to configure the shaped body 1 in a manner as shown in FIG. 2 (in broken lines), in which case, the side wall 5' would upwardly extend vertically along a non-curved line.

To the extent that the shaped bodies 1 in the surface 18' thereof are provided with recesses 19, additional connecting clamps (not shown in any detail) may be plugged thereinto. Moreover, such recesses 19 also are available for mounting, for example, reference signs.

The embodiments of the barrier according to FIGS. 4 to 7, in conjunction with FIG. 11, are special designs. Referring to FIG. 11, a cylindrically shaped element 15 (see FIGS. 4,5) is disposed between two shaped bodies 1 and is provided with a circumferential locking ledge 10. However, an interposed element of this type also may be—as shown in FIGS. 6–7, in the form of a shaped element 16 of maltese cross-type configuration. The configuration of the locking groove 9 and of the locking ledge 10 corresponds to the afore-going description. Incidentally, the shaped element 15 and the shaped element 16 may be furnished with a locking groove and locking ledge inverted with respect the illustration.

Possible patterns of curves of a barrier constituted by shaped bodies 1 are shown in FIG. 10. Such barriers may have shaped bodies. 1' (FIG. 8) at their opposite ends. The surface 18 of said shaped bodies 1' is bevelled, and the shaped body at one end of the barrier has a locking groove 9 and the shaped body at the opposite end has a locking ledge 10. The shaped body 1' shown in FIG. 8 has a locking groove 9. The shaped body 1' forming the other end of the barrier 1 then has a locking ledge 10, provided that no shaped element 15 or 16 is located within the barrier that would cause an inversion of the tongue-and-slot associations.

It is not specifically shown in the drawing that the shaped body 1 and the shaped elements 15, 16, respectively, are hollow bodies, as this is generally known. To enable the shaped bodies and shaped elements, respectively, to be filled with water, sand or the like, they are provided with sealable openings not shown either.

As the locking grooves 9 are open at the top and the locking ledges 10 are directed downwardly in tongue-shaped manner, the locking ledge 10 of one shaped body or element, may be simply inserted from the top into the locking groove 9 of an adjacent shaped body or element, and may then be placed into a straight or angular position, i.e. a troublesome "threading" of groove and ledge from the side will be eliminated. On the one hand, this will insure the shaped bodies to be adequately held together and, on the other hand, in the absence of any bolting aids, lateral start-up loads, if any, will result in a relatively easy separation of the locking connections of the shaped bodies so that damage is done thereto in very rare cases only, for example, in extreme and sudden exposure, if any.

What is claimed is:

1. A barrier comprised of a plurality of hollow shaped bodies of plastic material, each shaped body comprising (a) a wide base portion having a bearing face supporting the shaped body on a surface, (b) a narrower upper portion, (1) the wide base and narrower upper portions having two side walls, the portions of the side walls of the upper portion merging into the portions of the side walls of the base portion, (c) respective partially cylindrical end faces extending between the side walls, (1) the end face at one end of the shaped body being convex and the end face at an opposite end being correspondingly concave whereby adjacent end faces of successive ones of the shaped bodies in the barrier mate with each other, (2) the side walls having transitory portions converging towards the end faces, (d) a horizontally extending locking groove extending across the concave end face, the groove being open at the side walls and on top, and (e) a mating locking ledge extending horizontally across the convex end face at the same level as the locking groove whereby the locking edge may be inserted in an adjacent locking groove of the successive shaped bodies for connecting the shaped bodies.

2. The barrier of claim 1, wherein the partially cylindrical end faces have an arc length determined by an arc angle of 90°.

3. The barrier of claim 1, wherein the shaped body is constituted by two halves, each shaped body half having one planar side wall while the other side wall is concave.

4. The barrier of claim 1, wherein the locking groove defined in the concave end face has an inner face comprised of a vertical cylindrical part and an upwardly adjoining conical part, and an outer face comprised of a conical part opposite the vertical cylindrical inner face part, and the locking ledge protrudes from the convex end face downwardly, the locking groove and ledge being of mating configuration for locking engagement of the ledge in the groove.

5. The barrier of claim 1, further comprising a cylindrical shaped element disposed between the concave end faces of two successive shaped bodies, the shaped element comprising a circumferentially extending locking ledge at the same level as the locking grooves in the concave end faces whereby the locking edges may be inserted in the locking grooves of the successive shaped bodies for connecting the shaped bodies to the shaped element.

6. The barrier of claim 1, further comprising a maltese cross-shaped element disposed between the convex end faces of two successive shaped bodies, the maltese cross-shaped element comprising four concave faces matching the convex end faces and each of the four concave faces defining a locking groove at the same level and of the same length as the locking ledges on the convex end faces whereby the locking edges may be inserted in the locking grooves of the successive shaped bodies for connecting the shaped bodies to the shaped element.

7. The barrier of claim 1, further comprising respective ones of the shaped bodies at opposite ends of the barrier, the respective shaped bodies having bevelled upper surfaces opposite the bearing face, one of the respective shaped bodies having a locking groove and the shaped body at the opposite end having a locking ledge.

* * * * *